US010866059B2

(12) United States Patent
Haase et al.

(10) Patent No.: US 10,866,059 B2
(45) Date of Patent: Dec. 15, 2020

(54) COMPOSITE GRIP MODULE FOR A HANDGUN

(71) Applicant: Sig Sauer, Inc., Newington, NH (US)

(72) Inventors: Zachary Stephen Haase, Mont Vernon, NH (US); Phillip Harold Strader, Jr., Stratham, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/509,960

(22) Filed: Jul. 12, 2019

(65) Prior Publication Data

US 2020/0049449 A1 Feb. 13, 2020

Related U.S. Application Data

(60) Provisional application No. 62/715,616, filed on Aug. 7, 2018.

(51) Int. Cl.
*F41C 23/10* (2006.01)

(52) U.S. Cl.
CPC ..... *F41C 23/10* (2013.01)

(58) Field of Classification Search
CPC ..... F41C 23/10
USPC ..... 42/71.02
See application file for complete search history.

(56) References Cited

U.S. PATENT DOCUMENTS

| | | | | |
|---|---|---|---|---|
| 2,248,970 | A * | 7/1941 | Decker | F41A 19/40 42/51 |
| 3,023,527 | A * | 3/1962 | Leek | F41C 23/00 42/71.01 |
| 3,408,062 | A * | 10/1968 | Baker | F41C 23/06 267/135 |
| 6,432,559 | B1 * | 8/2002 | Tompkins | F41C 27/00 42/1.01 |
| 2008/0000379 | A1 * | 1/2008 | Hansen | F42B 7/046 102/517 |
| 2016/0158594 | A1 * | 6/2016 | Penney | A63B 21/4035 482/139 |

OTHER PUBLICATIONS

Shooting Sports Innovations, Tungsten Grip Module, Internet publication, archived Aug. 18, 2018 at: https://web.archive.org/web/20180818072725/http://shootingsportsinnovations.com/X5-Tungsten-Grip-Module-X5-Grip.htm, pp. 1-3, (with headers). (Year: 2018).*
Shooting Sports Innovations, Tungsten Grip Module, Internet publication, archived Aug. 18, 2018 at: https://web.archive.org/web/20180818072725/http://shootingsportsinnovations.com/X5-Tungsten-Grip-Module-X5-Grip.htm, pp. 1-3,(without headers). (Year: 2018).*
INGO INGunOwners.com, downloaded Mar. 7, 2020, Internet publication, pp. 1-3 (Year: 2020).*
GlockStore.com, Thug-Plug, Internet publication, archived Sep. 28, 2015 at: https://web.archive.org/web/20150928001553/https://www.glockstore.com/Thug-Plug, pp. 1-2. (Year: 2015).*

(Continued)

*Primary Examiner* — Bret Hayes
(74) *Attorney, Agent, or Firm* — Finch & Maloney PLLC

(57) ABSTRACT

A composite grip or grip module for a handgun is made from a polymer composite that includes a polymer and dense particles that increase the density of the grip. For example, the particles can be tungsten, tantalum, lead, iron, or mixtures thereof to provide a polymer density of greater than 2.5 grams per cubic centimeter.

24 Claims, 5 Drawing Sheets

(56) References Cited

OTHER PUBLICATIONS

"X5 Tungsten Grip Module", Shooting Sports Innovations, retrieved online at http://www.shootingsportsinnovations.com/X5-Tungsten-Grip-Module-X5-Tungsten-Grip.htm, 2019, 3 pages.

* cited by examiner

COMPOSITE GRIP MODULE FOR A HANDGUN

RELATED APPLICATIONS

This application claims priority under 35 U.S.C. § 119(e) to U.S. Provisional Patent Application No. 62/715,616 titled COMPOSITE GRIP MODULE FOR A HANDGUN, and filed on Aug. 7, 2018, the contents of which are incorporated herein by reference in its entirety.

FIELD OF THE DISCLOSURE

This disclosure relates to firearm components, and more particularly to grips for handguns.

BACKGROUND

Handgun grips can be molded out of polymeric material and secured to the operational portions of a handgun, such as the frame. Polymer molding and casting allows for a light grip that is mass producible and is resistant to environmental factors such as moisture and temperature changes.

SUMMARY

The present disclosure is directed to various embodiments of a grip module assembly of a firearm, a handgun with a grip module assembly, a grip or a grip module for a handgun, a handgun with a polymer composite grip with at least 5% metal particles by weight, and a method of making a grip module for a firearm. Numerous permutations and configurations will be apparent in light of the following detailed description.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
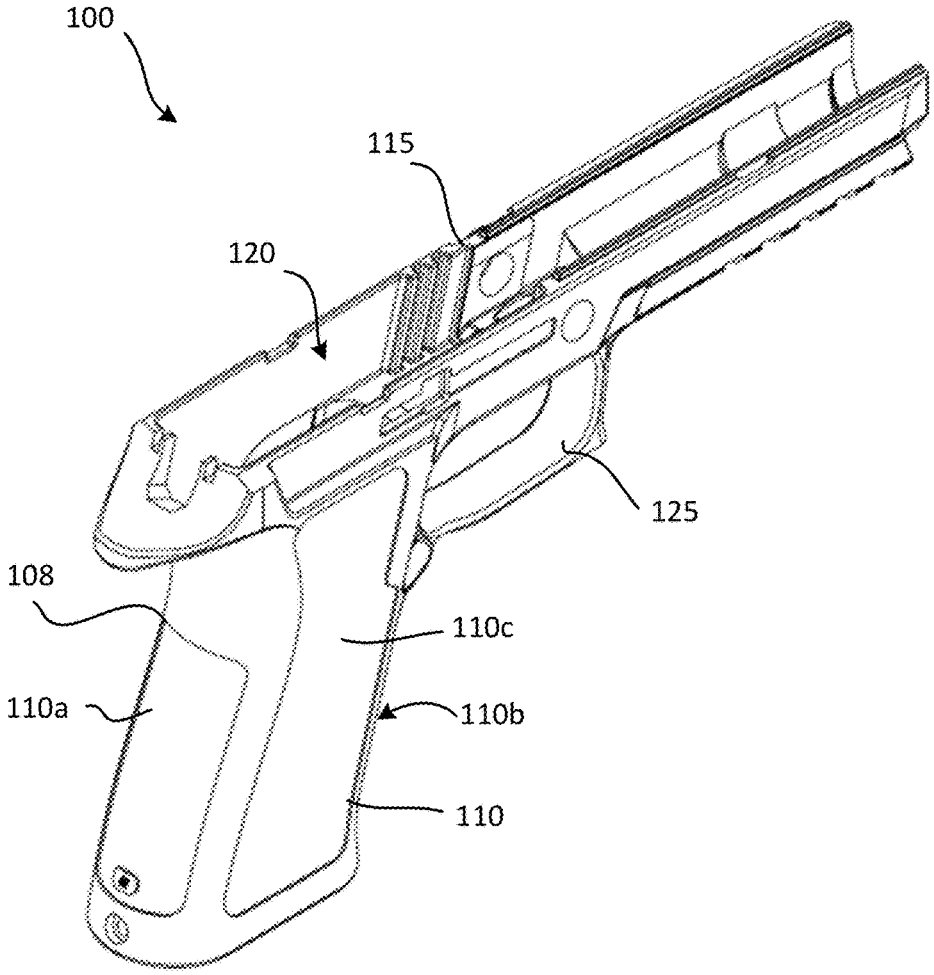
FIG. 1 is a perspective view showing an example of a handgun grip module, in accordance with an embodiment of the present disclosure.

The figures depict various embodiments of the present disclosure for purposes of illustration only. Numerous variations, configurations, and other embodiments will be apparent from the following detailed discussion

DETAILED DESCRIPTION

In one aspect, disclosed herein is a polymer composite grip or grip module for a handgun. The grip may be infused with a high-density material to increase the density and total mass of the grip. The increased mass in all or part of the grip or grip module can provide a more solid, weighty feel that many users prefer. In addition, targeted or general increases in mass can balance the handgun and can reduce the impact of recoil and felt recoil on the user. The present disclosure can also apply to grips on rifles, submachine guns, and carbines chambered for pistol ammunition or rifle ammunition. For example, a grip is attachable to the lower receiver of a semi-automatic pistol or rifle, such as a short-barreled rifle.

This description is merely exemplary in nature and is not intended to limit the present disclosure, application, or uses. As will be seen, the devices taught herein offer a grip that contributes, for example, to enhanced balance in a pistol or handgun and aids the user in managing recoil. For the purposes of the present disclosure, the terms pistol and handgun may be used interchangeably and include, for example, semi-automatic handguns.

General Overview

Polymer handguns, handguns with significant portions made from polymer, continue to gain in popularity. Polymer handguns provide several benefits, including damage resistance, thermal neutrality, reduced overall weight, and manufacturing economy. However, reduced weight comes with drawbacks, including reduced aiming stability and increased felt recoil. Disclosed herein, in at least one embodiment, is a handgun grip comprising a polymer composite infused with metal, thus maintaining the benefits of polymer, while adding the benefits of a targeted increase in mass.

The grip of a handgun is the primary interface for the user while shooting. During the act of shooting, a handgun produces recoil forces resulting from the controlled explosion of the round and resultant expulsion of the bullet and explosive gases. The recoil forces are exerted in the opposite direction of the travel of the bullet and typically are directed back towards the user. Recoil forces may cause the muzzle to move in an upward direction, referred to as "muzzle flip." Recoil forces also causes rearward movement of a slide during operation of a handgun. Recoil is transferred through the handgun to the user through the grip, often called "felt recoil." When shooting, muzzle flip and other effects of recoil move the handgun's point of aim away from the target, causing the user to have to adjust the handgun position to regain the sights on the target. The user's ability to manage the recoil and keep the desired point of aim on target directly impacts the user's ability to shoot accurately and precisely, especially during a rapid sequence of shots.

One way of reducing the felt recoil is to increase the mass of the handgun. Given equivalent recoil forces, a handgun with greater mass will experience lower acceleration and the user will experience less felt recoil. However, the distribution and center of the mass affects how the recoil moves the handgun and how manageable the handgun is to the user. Adding mass throughout a handgun, in particular a polymer handgun, may not be a desired feature, especially for users who wish to carry or shoot the handgun for extended periods of time. Thus, targeted addition of mass provides a better balance of features. Increased mass located at the grip reduces felt recoil in part by reducing muzzle flip, and by moving the center of mass closer to the grip and thus the user. Such targeted increases in mass may be desirable in competitive shooting, for example.

Limp-wristing is a phenomenon occasionally encountered by semi-automatic handgun users. This occurs where the user's grasp on the grip is not firm enough and the wrist is not held firm/straight enough to keep the frame of the handgun from traveling rearward while the bolt or slide of the handgun cycles. In essence, limp-wristing allows a greater portion of recoil force to be absorbed by the user's body rather than using that force to cycle the firearm's action. Limp-wristing can cause failures to cycle, which seriously hinder reliable operation. A handgun with reduced mass, or mass that is concentrated in the slide, such as a traditional polymer handgun, may be more prone to limp-wristing, as the mass of the handgun alone is insufficient to counter force from the travel of the slide. Such a reduced-mass handgun would depend more on the user's firm grasp and shooting form to prevent failures to cycle. A handgun of sufficient mass where the mass is not concentrated in the slide is able to counter the force of the traveling slide with less dependence on the user's technique. Such a handgun may inherently provide more reliable operation.

Mass added near the muzzle also helps to counter muzzle flip and reduce overall felt recoil. However, this affects the balance of the handgun as the center of mass is located away from the grip. Increasing the mass of the grip can counter mass located closer to the muzzle. By increasing the mass of the grip, the center of mass shifts closer to, or within the grip, providing a better balance to the user along with the reduction in felt recoil. In various embodiments, the polymer composite grip can shift the center of mass of the firearm backward, downward, or both, compared to the same grip absent the high-density particles. For at least reasons disclosed herein, it is evident that increased grip mass in a polymer handgun maintains the benefits of a polymer handgun, while removing downsides.

As discussed herein, a grip (or handgrip) refers to the portion of a handgun that the user grasps with the hand while manipulating the trigger. For example, the user's palm engages a backstrap and side of the grip, and some of the user's fingers wrap around the grip, leaving the index finger positioned to manipulate the trigger. The user's second hand may also grasp part of the grip and/or overlap the first hand to help stabilize the handgun while shooting. A portion of the grip may be connected to the frame of the handgun, although the grip does not necessarily include the frame, barrel, trigger or trigger guard.

As discussed herein, a grip module or grip module assembly refers to a grip that is part of or integrally formed with a larger portion of the handgun. For example, a grip module may include a handgrip portion, trigger guard, and receiver portion that extends along the bottom of the barrel and slide of a semi-automatic handgun. In some such embodiments, the handgrip portion defines a magazine well and the receiver portion defines a receiver well sized to receive a metal receiver that houses components of the fire control group. The handgrip portion can define a complete, unitary grip, or may include an underlying support structure to which one or more grip components can be attached to make a complete handgrip. For example, a grip module may have interchangeable backstraps, front straps, and/or side plates can be attached to the handgrip portion to result in a personalized grip sized to the user's hand and configured for a particular type of shooting.

For the purposes of the present disclosure, the terms grip, handgrip, grip module, and grip module assembly may be used interchangeably.

Example Structures

Figure 2:
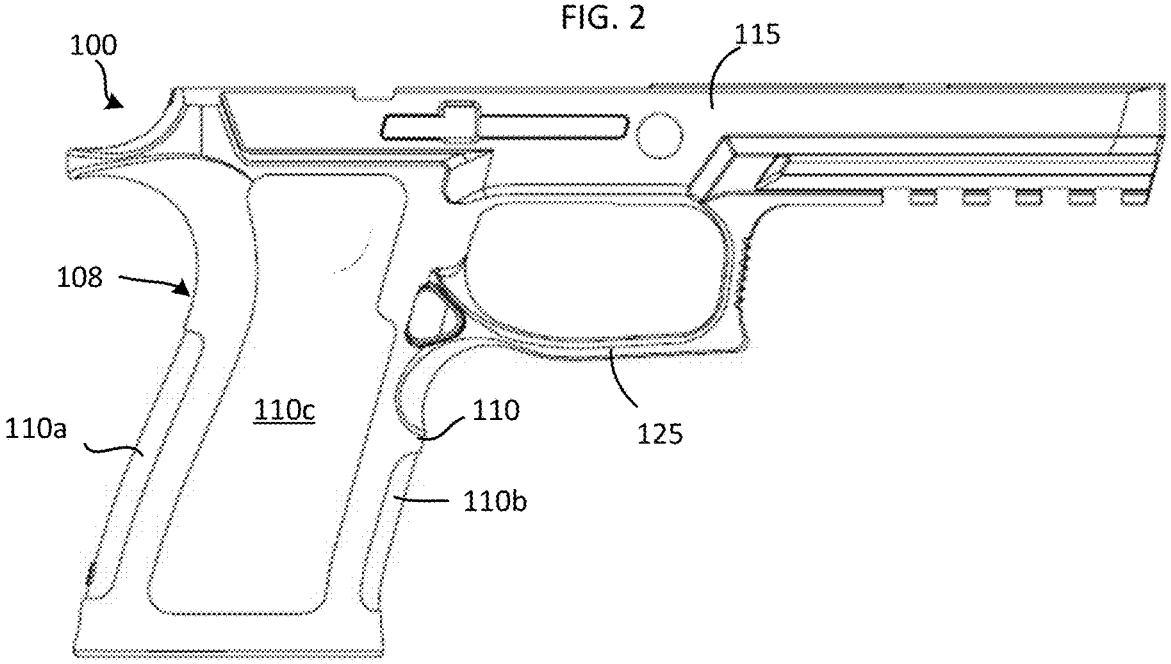
FIG. 2 is a side view of the handgun grip module of FIG. 1.

FIGS. 1-6 illustrate examples of grips and grip modules for a handgun, in accordance with some embodiments of the present disclosure. FIGS. 1 and 2 show a perspective view and a side view, respectively of a grip module 100 for a handgun. In this example, the grip module 100 includes a handgrip portion 108 extending down from a receiver portion 115 that is constructed to extend longitudinally along the barrel and slide of the handgun (not shown). The receiver portion 115 defines a receiver well 120 configured for installation of a receiver (not shown). A trigger guard 125 is connected between the front of the handgrip portion 110 and the bottom of the receiver portion 115. In this example, the handgrip portion 108 includes an integral handgrip 110 that includes a backstrap 110*a*, a front strap 110*b*, and sides 110*c* constructed as part of a single, monolithic grip module 100. In other embodiments, part of the handgrip 110 can include separate components that are removably attached to the handgrip portion 108 of the grip module 100. For example, the backstrap 110*a* is one of several backstraps 110*a* of different sizes that are interchangeable by the user for a customized grip fit.

Figure 3:
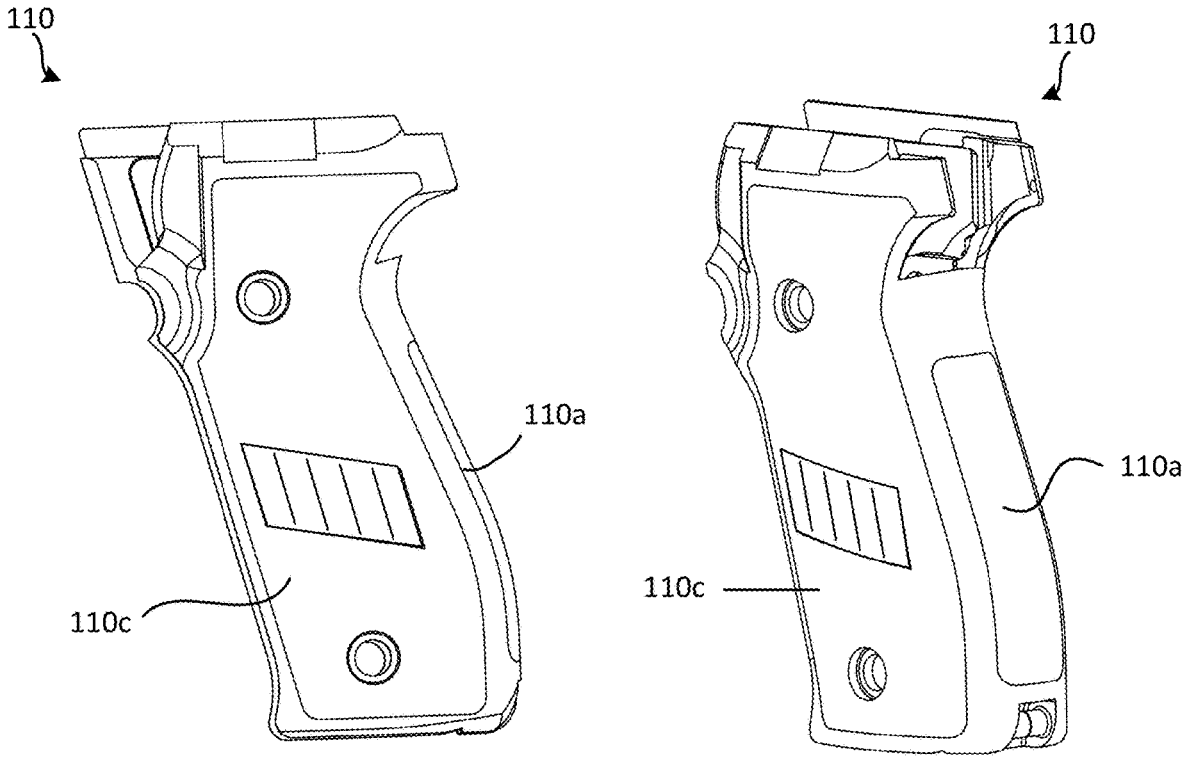
FIGS. 3-4 show a side view and a perspective view, respectively, of an example one-piece grip for a handgun, in accordance with an embodiment of the present disclosure.

FIG. 3 illustrates side and rear perspective views of a one-piece handgrip 110 for a handgun, in accordance with an embodiment of the present disclosure. In this example, the handgrip 110 is constructed to be installed on the handgrip portion 108 of a handgun frame or grip module 100, for example. The opposite sides 110*c* and backstrap 110*a* are connected as a single, unitary component.

Figure 4:
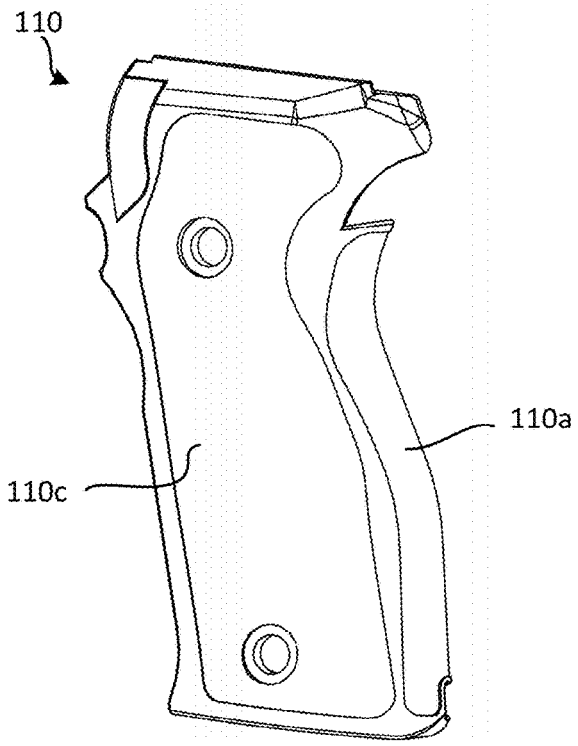

FIG. 4 illustrates one part of a two-piece handgrip 110, where each piece includes a side 110*c* and part of the backstrap 110*a*. The left and right portions of the two-piece handgrip 110 can be assembled on the frame or grip module 100 to result in grip similar to the one-piece handgrip 110 of FIG. 3, as will be appreciated.

Figure 5:
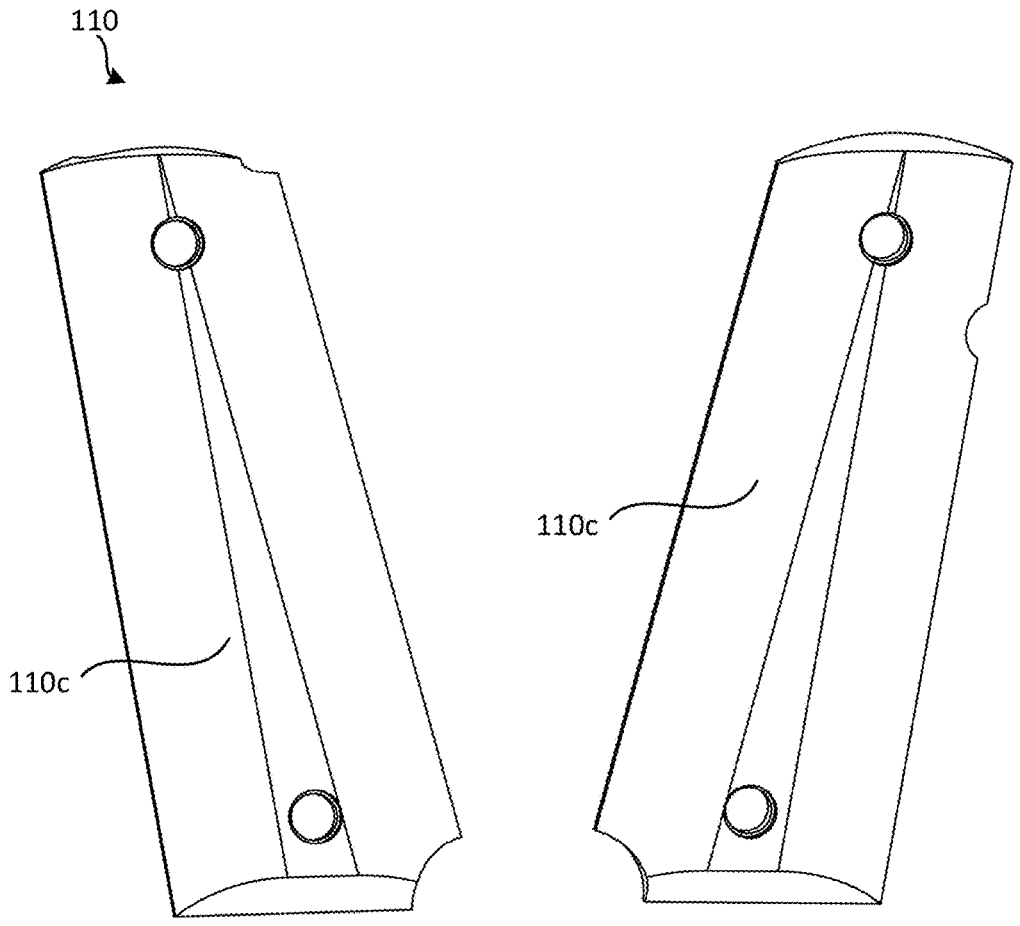
FIG. 5 is a side view showing an example of grip panels for a handgun, in accordance with an embodiment of the present disclosure.

FIG. 5 illustrates a side view of opposite sides 110*c* or grip panels of a handgrip 110, in accordance with another embodiment of the present disclosure. In this example, each side 110*c* is constructed to be fastened to the handgrip portion 108 of a handgun frame or grip module 100, as will be appreciated.

Figure 6:
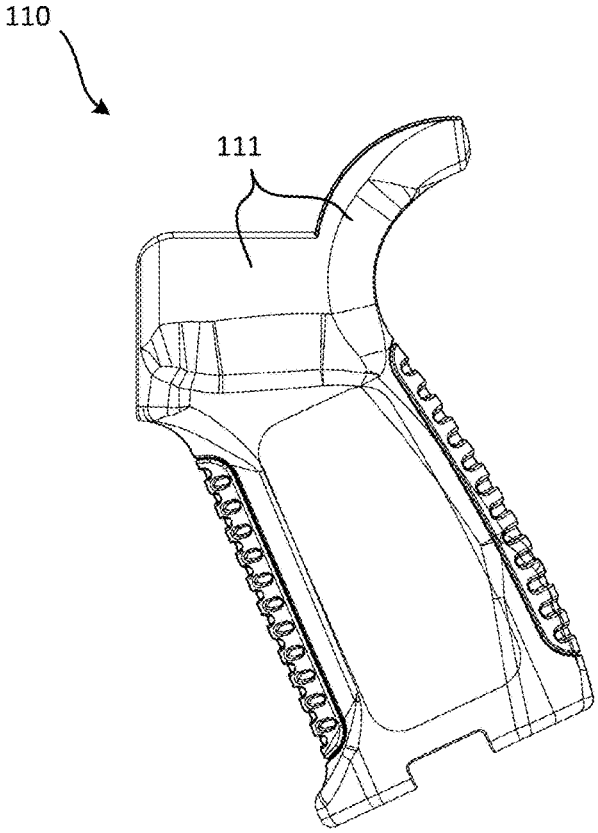
FIG. 6 is a side view showing an example handgrip configured for installation on the lower receiver of a carbine or other rifle, in accordance with an embodiment of the present disclosure.
Figure 7:
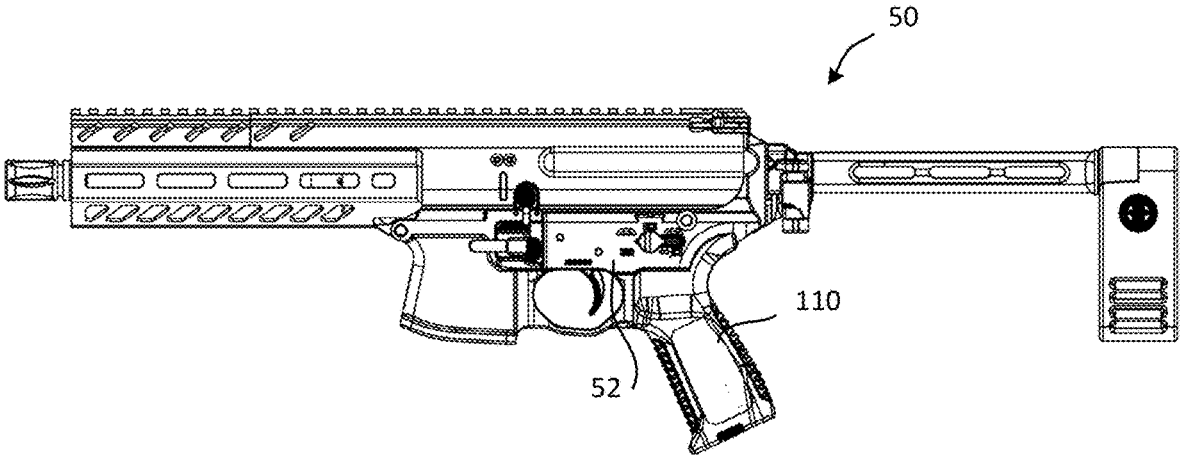
FIG. 7 is a side view showing a short-barreled rifle with the grip of FIG. 6, in accordance with an embodiment of the present disclosure.

FIG. 6 illustrates a side view of a handgrip 110 constructed for attachment to the lower receiver of a firearm 50, such as a carbine or short-barreled rifle. In this example, the handgrip 110 includes an upper portion 111 that mates with the firearm 50. FIG. 7 illustrates a side view of a firearm 50 with the handgrip 110 of FIG. 6 attached to the lower receiver 52.

A polymer composite grip or grip module 100 as disclosed herein can provide benefits as discussed. As used herein, a polymer composite is a composition that includes a polymer and one or more additional non-polymer components. In a composite, non-polymer components (e.g., powder) can be mixed with the polymer during initial polymerization or after re-melting the polymer and subsequent mixing with the base polymer, for example. The non-polymer components may be homogeneously or non-homogeneously distributed in the polymer. Non-polymer components may be organic or inorganic and can include, for example, metal fibers particles or flakes, glass fibers or beads, and ceramic particles or beads. The polymer composite grip may comprise a polymer infused with a high-density material to achieve densities greater than a grip comprised solely of polymer. In some embodiments, the polymer composite grip may be homogenous, with the high-density material evenly distributed throughout the material. In other embodiments, the high-density material may be more concentrated in certain locations of the grip module, absent from some locations of the grip module, or unevenly distributed throughout the composition. In various embodiments, the high-density material may be infused into the entire grip assembly or may be infused into a part of the grip assembly. In one such embodiment, high-density material, such as metal granules, is fused or embedded into the outside surface of the polymer material of the grip module 100.

Figure 8:
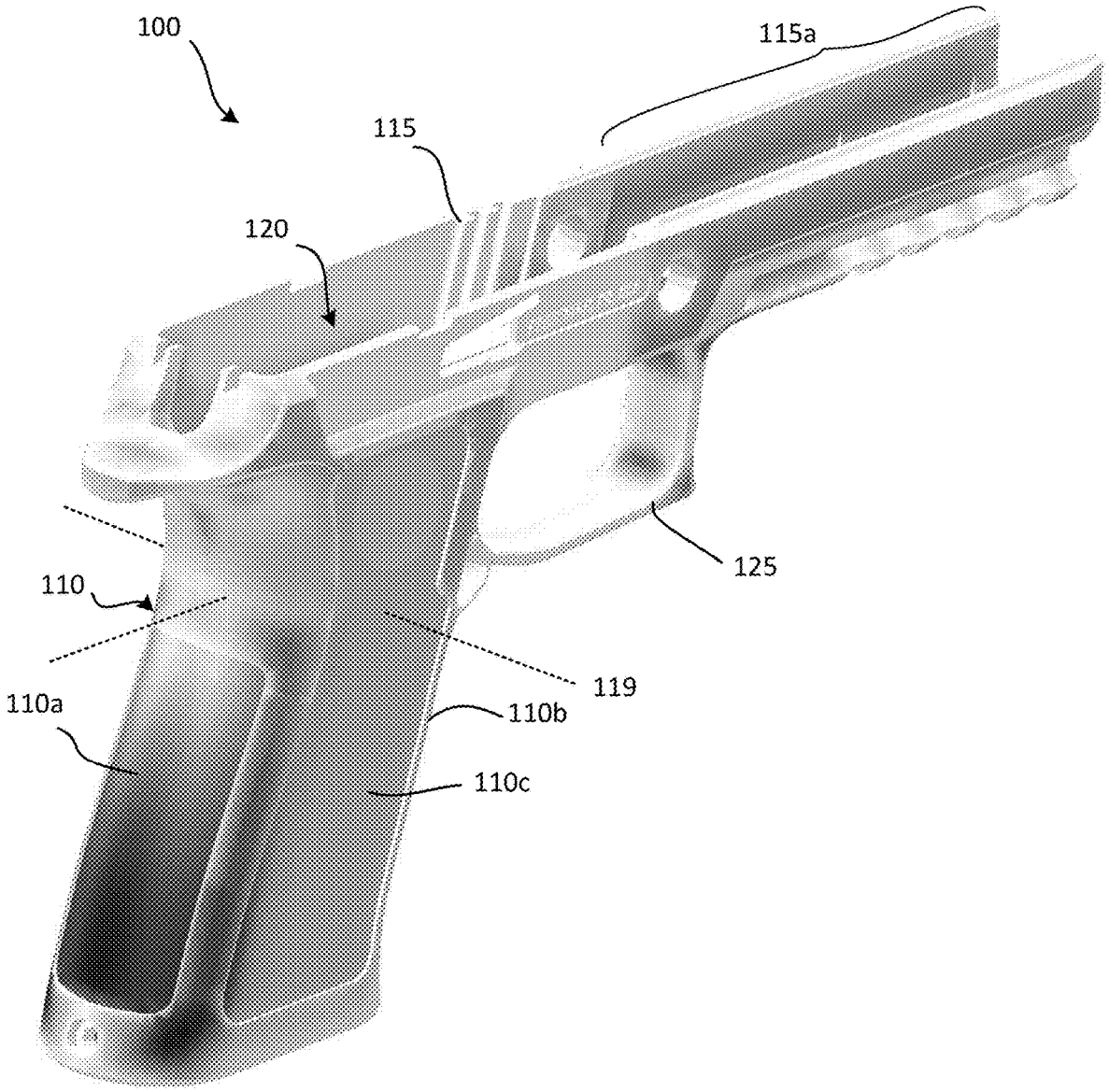
FIG. 8 is a rear perspective view of a grip module that is shaded to show variations in density, in accordance with an embodiment of the present disclosure.

FIG. 8 illustrates a rear perspective view of a grip module with shading indicative of the relative density of the material, in accordance with an embodiment of the present disclosure. In this example, darker shading generally indicates a region of increased density. The grip module 100 in this example has the same geometry as the grip module 100 of FIG. 1 and a discussion of the components will not be repeated here. As can be seen in FIG. 8, the grip module 100 has increased density in the handgrip 110 and along a distal end portion 115*a* of the receiver portion 115. More specifically, the lower part of the backstrap 110*a* and the receiver portion 115 forward of the trigger guard 125 have increased concentrations of high-density material, such as tungsten powder. In some such embodiments, the forward or distal end portion 115*a* of the receiver portion 115 has an increased density adjacent the handgun muzzle. The additional high-density material in one or both of these regions results in increased material density in these regions and a grip module 100 with a density gradient. The difference in material density between regions of higher density and regions of lower density can be gradual or abrupt. For example, the density gradually increases moving distally along the receiver portion 115. Similarly, the density may gradually increase moving from high to low along the handgrip 110. In another example, the density along the lower part of the handgrip 110 is relatively uniform but is greater than that of other regions of the handgrip 110 and greater than that of other regions of the grip module 100.

The extra mass in the receiver portion 115 adjacent the muzzle can help the shooter to control muzzle rise and help the shooter return to target quicker after firing a shot. The extra mass in the handgrip 110 results in a center of mass 119 that is closer to the user, making the handgun feel more like it is in the user's hands rather than protruding from the hands. One or both regions of increased mass can be implemented, in accordance with some embodiments.

A polymer grip or grip module as disclosed herein may also exhibit increased thermal conductivity relative to traditional polymer grips. Increased thermal conductivity may improve heat conduction away from the slide and barrel assembly. In different embodiments, thermal conductivity (W/m° K) may be increased by greater than 50%, greater than 100%, greater than 200% or greater than 300% when compared to the same polymer without added particles.

A polymer composite grip as disclosed herein may be viewed as premium or more desirable by users compared with traditional polymer grips. Increased mass, and thus weight, may impart a feeling of solidity or substantiality that users may attribute to durability. The use of "premium" materials, such tungsten, a rare metal, may also impute the premium characteristic to the grip, making the grip more desirable to users.

A range of polymers may be suitable for use in embodiments of the polymer composite grip. Polymers may include those materials traditionally used to make grip assemblies, such as thermoplastics and thermosets. Thermosets may include thermosetting phenol resins, such as a fiber-reinforced plastic sold as Duroplast®. Thermoplastics generally lend themselves to use in handgun grips for their durability and ease of use in manufacturing. Thermoplastics may include polyamides, polyamide-imides, ABS, polycarbonates, and polyether ether ketones (PEEK). Polyamides may include a polyamide material sold as Grilamid® LV-23 ESD, Polyamide/Nylon 12, a nylon resin sold as Zytel® by DuPont, Nylon 6, and Nylon 66. It should be noted that many polymers are reinforced by other materials, such as fiberglass, and the range of suitable polymers may include reinforced polymers. A polymer composite can optionally include a combination of polymers and a combination of fillers.

A number of techniques can be used to form a polymer or polymer composite grip assembly. For example, the grip may be molded or cast. Molding techniques include, for example, injection molding, transfer molding, or compression molding. Melt flow rate, and related properties melt flow index (MFI), melt index (MI), or melt mass-flow rate (MFR), may be used to identify suitable polymer(s). Melt flow rate is a measure of the ease of flow of melted plastic and represents a typical index for quality control and selection of thermoplastics. The MFI of suitable polymers may be in the range of, but is not limited to, about: 0.1 to 10 g/10 min, 1 to 20 g/10 min, 10 to 80 g/10 min, 5 to 60 g/10 min, or 1 to 80 g/10 min using ASTM D1238.

A variety of injection molding methodologies can be employed to make a grip module in accordance with some embodiments of the present disclosure. One such method is co-injection molding using a first polymer composition and a second polymer composition. The first composition does not include high-density material and the second polymer composition contains high-density material. In accordance with one embodiment, the first and second polymer compositions are injected through the same gate: an exterior "skin" of the first polymer is initially injected and then the second polymer material is injected slightly after the first polymer. The first polymer forms a skin that effectively encapsulates a core of the second polymer.

Such an embodiment is particularly useful when the high-density material is toxic, such as lead powder. The skin of the first polymer material prevents the high-density material (e.g., lead powder) from release as a result of scraping and/or abrasion of the grip module during normal use. In some such embodiments, the distribution of higher-density polymer is relatively uniform among various regions of the grip module even though the material at any given location may exhibit a density gradient across the thickness of the material.

In another embodiment, multi-gate injection molding is used. For example, material is injected into a mold cavity from two or more separate gates. The mold cavity fills from multiple locations and eventually the multiple material streams converge and bond to each other. Multi-gate injection molding can enable specific density targeting to result in targeted regions of the grip module having greater density. For example, one of the gates is positioned to fill the handgrip portion of the mold and injects a polymer composition containing high-density material.

In another embodiment, an over molding approach is used. In such a process, one material is injected and then a second material is molded over it. Over molding allows increased control for specific density/mass distribution across the grip module.

In yet another embodiment, non-homogenous, low-mix molding is used. For example, different materials with slightly different melt temperatures are minimally mixed prior to injection. This technique is commonly used to achieve a "marbled" appearance. Such an approach may result in a generally even distribution of mass throughout the grip module rather than targeted regions of increased density. Numerous variations and embodiments will be apparent in light of the present disclosure.

A range of high-density materials may be suitable for use in embodiments of the polymer composite grip. High-density materials may include metals, metal carbides such as tungsten carbide, metal alloys, metal oxides, ceramics, and ceramic metals (cermets). Examples of high-density metals may include tungsten, iridium, silver, tantalum, gold, osmium, platinum, uranium, hafnium, palladium, lead, silver, molybdenum, actinium, bismuth, copper, nickel and iron. The density of a high-density material may be in the range of, for example, greater than 7 g/cm$^3$, greater than 10 g/cm$^3$, greater than 12 g/cm$^3$ or greater than 15 g/cm$^3$. In some embodiments, the high-density material has a density of at least 7 g/cm$^3$, at least 8 g/cm$^3$, at least 10 g/cm$^3$, at least 12 g/cm$^3$, at least 14 g/cm$^3$, at least 16 g/cm$^3$, or at least 18 g/cm$^3$. In other embodiments, the high-density material can have a density in the range of about: 3 to 5 g/cm$^3$, 5 to 10 g/cm$^3$, 3 to 10 g/cm$^3$, 10 to 15 g/cm$^3$, 3 to 15 g/cm$^3$, 5 to 15 g/cm$^3$, 15 to 19 g/cm$^3$, 10 to 19 g/cm$^3$, 5 to 19 g/cm$^3$, 19 to 22.6 g/cm$^3$, or 10 to 22.6 g/cm$^3$. Other ranges within these ranges are possible. A high-density material may be a combination or mixture of high-density materials.

In different embodiments, the density of the polymer composite grip may be greater than 1.5, greater than 2, greater than 2.5, greater than 3, greater than 3.5, or greater than 4 g/cm$^3$. In other cases, the density can be in the range of, but is not limited to, about: 2 to 2.5 g/cm$^3$, 2.5 to 3 g/cm$^3$, 3 to 5 g/cm$^3$, 2 to 5 g/cm$^3$, 3 to 5 g/cm$^3$, 3.5 to 4.5 g/cm$^3$, 5 to 10 g/cm$^3$ or 2 to 10 g/cm$^3$.

High density materials allow the polymer composite grip to exhibit a high density while retaining a majority of polymer (by volume) within the grip. For example, tungsten has a density of 19.3 g/cm$^3$. Thus, for example, a grip with a density greater than 3 g/cm$^3$ may be formed with less than 50% tungsten by volume. The same grip could therefore comprise more than 50% polymer by volume. Percent by volume (volume %) of high-density material (e.g., metal) in the grip may be in the range of, but is not limited to, about: 1% to 5%, 5% to 10%, 10% to 15%, 1% to 15%, 5% to 15%, 15% to 20%, 5% to 25%, 20% to 30%, 30% to 50%, or 50% to 75%. Other ranges within these ranges are possible. Percent by volume (volume %) of polymer in the polymer composite grip may be in the range of, but is not limited to, about: 99% to 95%, 95% to 90%, 90% to 85%, 99% to 85%, 85% to 80%, 95% to 75%, 80% to 70%, 70% to 50%, or 50% to 25%. Other ranges within these ranges are possible. The weight ratio of particles to polymer in the composition can be, for example, greater than 1:2, 1:1, 1.5:1, 2:1, 3:1, or 4:1. In the same and other embodiments, the weight ratio of particles to polymer can be, for example, less than 50:1, less than 25:1, less than 10:1, less than 5:1 or less than 3:1. In some embodiments, the polymer composite can comprise, by weight, greater than 10%, greater than 20%, greater than 40%, greater than 50%, greater than 60%, greater than 70%, greater than 80%, or greater than 90% metal.

In at least one embodiment, the high-density material infused in the composite is in particle form. The particles may be homogeneously dispersed throughout the composite. The particles may be uniform in size. The particles may be non-uniform in size. The standard deviation of the particle diameter can be less than 50%, less than 30%, or less than 20% of the average diameter. In other embodiments, the standard deviation of the particle diameter can be greater than 10%, greater than 20%, or greater than 50% of the average diameter. Particle size may refer to an average of the sizes of individual particles. Particle size, or average particle diameter, may range from, but is not limited to, about: 0.1 μm to 10 μm, 10 μm-50 μm, 0.1 μm to 50 μm, 50 μm to 75 μm, 10 μm to 75 μm, 75 μm to 100 μm, 10 μm to 100 μm, 100 μm to 500 μm, 500 μm to 1000 μm, or 1000 μm to 2000 μm. Particles may be, for example, generally spherical, cylindrical, flakes, granules, have an amorphous/irregular shape, or combinations of these geometries. In some cases, the only metal in the polymer composite is metal particles, such as granules, flakes, or powder. The polymer composite may be attached to metal parts other than the particles, but the metal parts are not homogeneously dispersed throughout the polymer.

The size of the particles and the concentration of particles in the composite may be at least partially chosen by limiting the particles to a concentration that does not alter the viscosity of the melt to a level where it becomes difficult to mold. For example, the composite may exhibit a melt flow index (MFI) that is within 10%, within 20%, or within 50% of the MFI of the same polymer in the absence of high-density particles.

In one or more embodiments, a polymer composite grip may retain the color of the component materials. For example, tungsten-infused polymer may provide a gray tone to the composite. In at least one embodiment, pigment or other colorant may be added to color the polymer composite grip.

Example Firearm Application

In one example, 22 cm$^3$ of tungsten particles (424.6 g) are added to 78 cm$^3$ of Nylon (91.3 g) and the materials are compounded together above the glass transition temperature of the Nylon. The density of the polymer is increased from 1.17 g/cm$^3$ to 5.1 g/cm$^3$. The composite melt is injected into an injection mold for a pistol grip. The mold is allowed to cool and the grip is removed. The resulting grip has the same geometry as a grip made using the same mold and polymer without metal particles but is more than 4 times as dense as a result of including the tungsten particles. The resulting grip can be used interchangeably with a traditional polymer grip.

Further Example Embodiments

The following examples pertain to further embodiments from which numerous permutations and configurations will be apparent.

Example 1 is a grip module for a firearm comprising a polymer composite grip module having a density greater than 2.5 grams per cubic centimeter.

Example 2 includes the subject matter of Example 1, wherein the polymer composite grip module includes a handgrip portion and a receiver portion, the receiver portion configured to accept a receiver or frame of the firearm.

Example 3 includes the subject matter of Example 1 or 2, wherein the firearm is a handgun.

Example 4 includes the subject matter of any of Examples 1-3, wherein the polymer composite grip module comprises a polymer infused with metal.

Example 5 includes the subject matter of any of Examples 1-3, wherein the polymer composite grip module comprises a polymer and metal particles, at least some of the metal particles embedded into a surface of the polymer.

Example 6 includes the subject matter of Example 4 or 5, wherein the metal comprises one or more of tungsten, tantalum, lead, and iron.

Example 7 includes the subject matter of any of Examples 4-6, wherein the polymer comprises polyamide.

Example 8 includes the subject matter of Example 7, wherein the metal includes tantalum.

Example 9 includes the subject matter of Example 7, wherein the metal includes tungsten.

Example 10 includes the subject matter of Example 9 comprising at least 20% tungsten by weight.

Example 11 includes the subject matter of any of Examples 4-10, wherein the metal comprises metal particles that are homogeneously dispersed in the polymer.

Example 12 includes the subject matter of any of Examples 4-10, wherein the metal comprises metal particles that are non-uniformly distributed throughout the grip module.

Example 13 includes the subject matter of any of Examples 1-7, wherein the polymer composite grip module comprises high-density particles. For example, high-density particles have a density of at least 7 g/cm$^3$. In another example, the high-density particles have a density of at least 10 g/cm$^3$.

Example 14 includes the subject matter of Example 13, wherein the polymer composite grip comprises at least 50% polymer by volume.

Example 15 includes the subject matter of Example 13, wherein the polymer composite grip comprises at least 80% polymer by volume.

Example 16 includes the subject matter of Example 13, wherein the polymer composite comprises less than 50% metal by volume.

Example 17 includes the subject matter of Example 13, wherein the high-density particles are unevenly distributed throughout the grip module.

Example 18 includes the subject matter of Example 17, wherein the high-density particles have a greater concentration in a backstrap portion of the grip module.

Example 19 includes the subject matter of Example 17, wherein the high-density particles have a greater concentration in a distal portion of the receiver portion of the grip module.

Example 20 includes the subject matter of any of Examples 17-19, wherein the high-density particles have a greater concentration in a lower part of the handgrip portion of the grip module.

Example 21 includes the subject matter of any of Examples 13-20, wherein the high-density particles comprise one or more of tungsten, tantalum, lead, and iron.

Example 22 includes the subject matter of any of Examples 13-21, wherein the polymer composite grip module has a density of at least 3 grams per cubic centimeter.

Example 23 includes the subject matter of any of Examples 13-21, wherein the polymer composite grip module has a density of at least 3.5 grams per cubic centimeter.

Example 24 includes the subject matter of any of Examples 13-21, wherein the polymer composite grip module has a density from 3-5 grams per cubic centimeter.

Example 25 includes the subject matter of any of Examples 1-24, wherein a center of mass of the grip module is located within the handgrip portion.

Example 26 is a handgun comprising the grip module of any of Examples 1-25.

Example 27 includes the subject matter of Example 26, wherein the grip module is part of a semi-automatic pistol.

Example 28 includes the subject matter of Example 26 or 27, wherein a center of mass of the handgun is located within the polymer composite grip.

Example 29 includes the subject matter of any of Examples 26-28, wherein the grip module is injection molded.

Example 30 includes the subject matter of any of Examples 26-28, wherein the grip module is cast.

Example 31 includes the subject matter of any of Examples 26-28, wherein the grip is compression molded or transfer molded.

Example 32 includes the subject matter of any of Examples 1-31, wherein the grip module comprises metal particles having an average diameter less than 1 mm.

Example 33 includes the subject matter of Example 32, wherein the grip module comprises greater than 1% tungsten or tantalum by volume.

Example 34 is a grip for a handgun, the grip comprising metal particles and a polymer.

Example 35 includes the subject matter of any of Example 34 comprising at least 5% by weight of the metal particles.

Example 36 includes the subject matter of any of Examples 34-35, wherein the grip comprises at least 50% polymer by volume.

Example 37 includes the subject matter of any of Examples 34-35, wherein the grip comprises at least 75% polymer by volume.

Example 38 includes the subject matter of any of Examples 34-35, wherein the grip comprises less than 50% metal by volume.

Example 39 includes the subject matter of any of Examples 34-38, wherein the metal particles comprise at least one of tungsten and tantalum.

Example 40 is a method of making a grip module, the method comprising molding a polymer composite into a handgun grip, the polymer composite comprising metal particles.

Example 41 includes the subject matter of Example 40, wherein molding the polymer includes injecting a first polymer composition of a first density and injecting a second polymer composition containing the metal particles and having a second density greater than the first density.

Example 42 includes the subject matter of Example 41, wherein the first polymer composition encapsulates the second polymer composition.

Example 43 includes the subject matter of Example 41, wherein the second polymer composition is injected only in the handgrip portion of the grip module.

Example 44 includes the subject matter of Example 41, wherein the second polymer composition is injected only in a handgrip portion and a distal receiver portion.

Example 45 is a method of making a grip module, the method comprising casting a polymer composite into a handgun grip, the polymer composite comprising metal particles.

Example 46 includes the subject matter of Example 45, wherein the metal particles comprise at least one of tungsten and tantalum.

Example 47 is a method of making a grip module, the method comprising combining metal particles with a polymer melt to produce a polymer composite, the polymer melt having a first MFI and the polymer composite having a second MFI that is within 50% of the first MFI and injecting the polymer composite into a mold to produce the grip module.

Example 48 includes the subject matter of Example 47 where the second MFI is within 40%, within 30%, within 20% or within 10% of the first MFI.

Example 49 includes the subject matter of Example 47 or 48 where the volume percent of the metal particles in the grip module is 1% to 5%, 5% to 10%, 10% to 15%, 1% to 15%, 5% to 15%, 15% to 20%, 5% to 25%, 20% to 30%, 30% to 50%, or 50% to 75%.

The foregoing description has been presented for the purposes of illustration and example. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A grip module for a handgun, the grip module comprising:

a handgrip portion extending downwardly; and a receiver portion extending forward from the handgrip portion;

wherein the handgrip portion and the receiver portion are made of a polymer composite having metal particles dispersed throughout an entire volume of the polymer, the grip module having a density greater than 2.5 grams per cubic centimeter.

2. The grip module of claim 1, wherein a center of mass of the grip module is located within the handgrip portion.

3. The module of claim 1 further comprising metal particles embedded into a surface of the grip module.

4. The grip module of claim 1, wherein the metal particles comprise one or more of tungsten, tantalum, lead, and iron.

5. The grip module of claim 4, wherein the polymer comprises polyamide.

6. The grip module of claim 5 wherein the polymer composite comprises at least 20% tungsten by weight.

7. The grip module of claim 1, wherein the metal particles are homogeneously dispersed throughout the entire volume of the polymer.

8. The grip module of claim 1, wherein the metal particles have a density of at least 7 g/cm$^3$.

9. The grip module of claim 8, wherein the polymer composite comprises at least 50% polymer by volume.

10. The grip module of claim 8, wherein the polymer composite comprises at least 80% polymer by volume.

11. The grip module of claim 8, wherein the polymer composite comprises less than 50% metal particles by volume.

12. The grip module of claim 8, wherein the metal particles are non-uniformly distributed throughout the grip module.

13. The grip module of claim 12, wherein the metal particles have a greater concentration in a backstrap portion of the grip module compared to neighboring portions of the grip module.

14. The grip module of claim 12, wherein the metal particles have a greater concentration in a distal portion of the receiver portion of the grip module compared to neighboring portions of the grip module.

15. The grip module of claim 12, wherein the metal particles have a greater concentration in a lower part of the handgrip portion of the grip module compared to neighboring portions of the grip module.

16. The grip module of claim 8, wherein the metal particles comprise one or more of tungsten, tantalum, lead, and iron.

17. The grip module of claim 8, wherein the grip module has a density of at least 3 grams per cubic centimeter.

18. The grip module of claim 8, wherein the grip module has a density of at least 3.5 grams per cubic centimeter.

19. A handgun, comprising the grip module of claim 1.

20. The handgun of claim 19, wherein a center of mass of the handgun is located within the grip module.

21. The grip module of claim 1, wherein the metal particles have an average diameter less than 1 mm.

22. The handgun of claim 19, wherein the polymer composite comprises greater than 1% tungsten or tantalum by volume.

23. A grip module for a handgun, the grip module made of a polymer having metal particles dispersed throughout an entire volume of the polymer, wherein the grip module has a density greater than 2.5 grams per cubic centimeter.

24. The grip module of claim 23, wherein the metal particles comprise tungsten.

* * * * *